United States Patent [19]
Himmelmann
[11] Patent Number: 4,543,324
[45] Date of Patent: Sep. 24, 1985

[54] PROCESS FOR HARDENING PHOTOGRAPHIC GELATIN WITH VINYL SULFONES CONTAINING SULFONYL ETHYL SULFATE GROUPS

[75] Inventor: Wolgang Himmelmann, Leverkusen, Fed. Rep. of Germany

[73] Assignee: Agfa-Gevaert Aktiengesellschaft, Leverkusen, Fed. Rep. of Germany

[21] Appl. No.: 654,534

[22] Filed: Sep. 26, 1984

[30] Foreign Application Priority Data

Jul. 3, 1982 [DE] Fed. Rep. of Germany ..... 3224983

[51] Int. Cl.[4] ..... G03C 1/30

[52] U.S. Cl. ..... 430/622; 430/623; 430/626; 260/117; 260/112 R; 106/125

[58] Field of Search ..... 430/622, 623, 621, 626, 430/930; 260/117, 112; 106/125

[56] References Cited

U.S. PATENT DOCUMENTS 4,323,646 4/1982 Bergthaller et al. ..... 430/622
4,338,394 7/1982 Himmelmann et al. ..... 430/621

*Primary Examiner*—Won H. Louie
*Attorney, Agent, or Firm*—Connolly and Hutz

[57] ABSTRACT

The difficulties in the casting process of photographic gelatin containing layers caused by increases in the viscosity of the casting solution due to the premature cross-linking of gelatin can be prevented if a compound containing at least one vinyl sulfone group and at least one sulfonyl ethyl sulfate group in the form of their salts is incorporated in the casting composition of the gelatin-containing layer(s) or in the gelatin-containing layer(s) applied to the layer support.

4 Claims, 1 Drawing Figure

Figure 1:
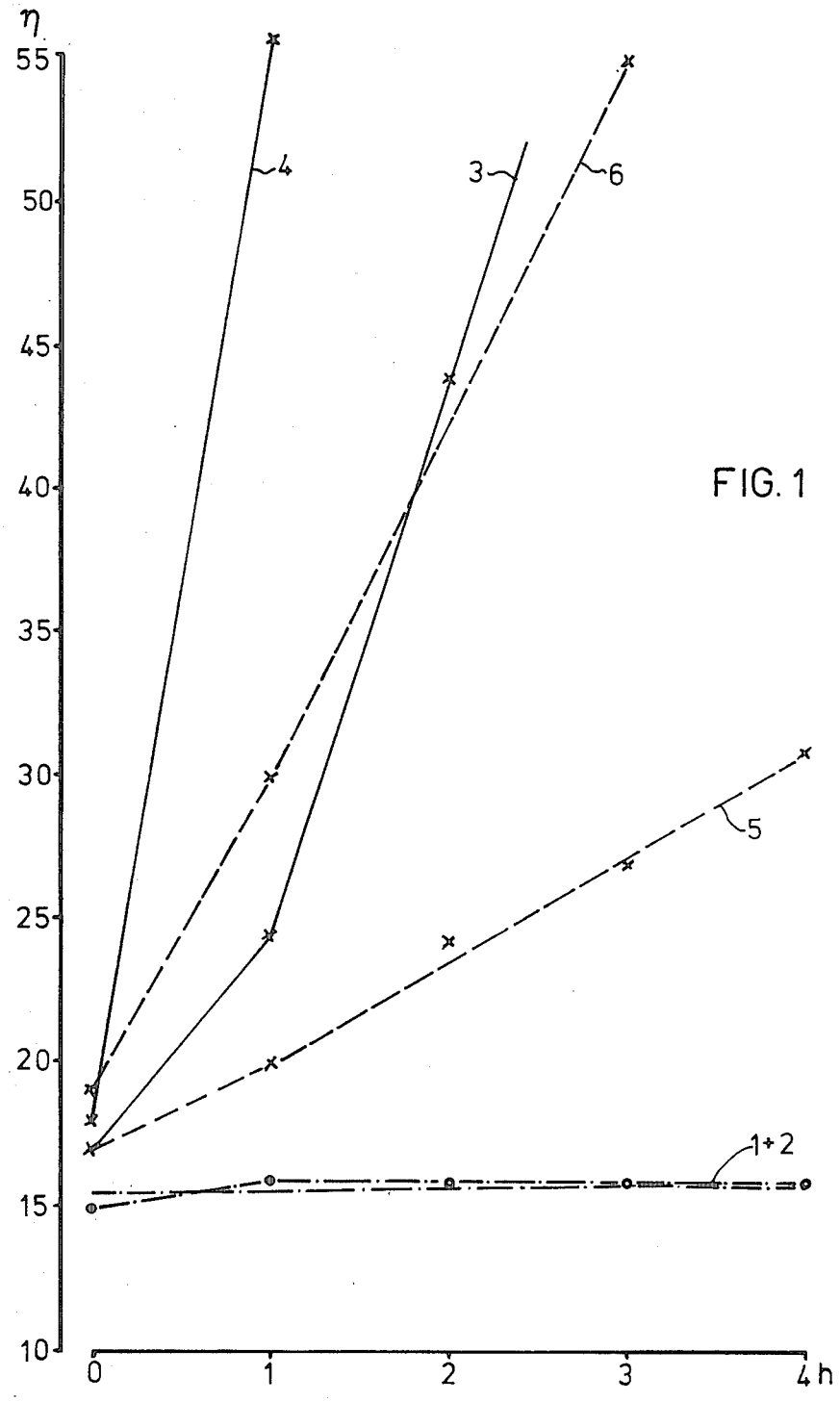

PROCESS FOR HARDENING PHOTOGRAPHIC GELATIN WITH VINYL SULFONES CONTAINING SULFONYL ETHYL SULFATE GROUPS

Cross Reference to Related Applications

This application is a continuation of U.S. patent application Ser. No. 506,510, filed June 21, 1983 now abandoned for Process for Hardening Photographic Gelatin with Vinyl Sulfones Containing Sulfonyl Ethyl Sulfate Groups by Wolfgang Himmelmann.

This invention relates to a process for the hardening of photographic gelatins or photographic layers containing such gelatins.

Numerous substances have been described as hardeners for proteins and in particular for gelatin, including, for example, metal salts such as chromium, aluminium and zirconium salts, aldehydes and halogenated aldehyde compounds, in particular formaldehyde, dialdehydes and mucochloric acid, 1,2- and 1,4-diketones such as cyclohexane-1,2-dione and quinones, as well as chlorides of di-basic organic acids, anhydrides of tetracarboxylic acids, compounds containing several reactive vinyl groups, such as vinyl sulfones, acrylamides, compounds containing at least two heterocyclic 3-membered rings which are easily split open, such as ethylene oxide and ethylene imine, polyfunctional methane sulfonic acid esters and bis-α-chloroacylamido compounds.

High molecular weight hardeners, such as polyacrolein and its derivatives and copolymers and alginic acid derivatives have recently become known; these are used especially as hardeners which are confined to their layer.

The use of the above mentioned compounds for photographic purposes has, however, numerous serious disadvantages. Some of these compounds are photographically active and therefore unsuitable for hardening photographic materials, while others have such an adverse effect on the physical properties, as for example the fragility of gelatin layers, that they are unusable for this purpose. Others again cause discolorations or a change in pH during the hardening reaction. Furthermore, for hardening photographic layers it is particularly important that hardening should reach its maximum as soon as possible after drying so that the material to be hardened does not continuously change in its permeability to developer solution as would be the case, for example, if mucochloric acid or formaldehyde were used.

Some cross-linking agents for gelatin, such as ethylene imine compounds, for example, also have a damaging effect on the skin so that their use is unsuitable on physiological grounds.

It is also known that trichlorotriazine, hydroxydichlorotriazine and dichloroaminotriazines may be used as hardeners. The disadvantage of these compounds is their relatively high vapour pressure, the fact that they split off hydrochloric acid during hardening and the physiological action of these compounds. Water-soluble derivatives containing carboxylic and sulfonic acid groups and obtained by the reaction of cyanuric chloride with one mol of an amino alkyl or diamino aryl sulfonic or carboxylic acid do not show these disadvantages and have therefore recently been proposed as hardeners. Their usefulness in practice is, however, limited since, owing to their high solubility, they decompose when left to stand in aqueous solutions and therefore rapidly lose their effect.

Lastly, if a hardener is to be suitable for photographic layers containing gelatin, it is very important, for the purpose of preparation as well as of processing, that the onset of the cross-linking reaction should be determinable within certain limits, for example by a suitable choice of the drying temperature or of the pH.

Compounds having two or more acrylic acid amido groups in the molecule, N,N',N''-tris-acryloyl-hydrotriazine or methylene-bis-acrylamide, are also known as hardeners for photographic gelatin layers.

Although hardening of the compounds is satisfactory after some time, the comparative insolubility of the compounds in water may lead to uneven hardening within the layer.

High speed processing of photographic materials, in particular of color photographic materials, which is being increasingly used, makes special demands on the mechanical properties and swelling properties of the materials and gives rise to special problems, added to which are the difficulties arising from the necessity to produce ever thinner photographic layers. Attempts have been made to solve these problems by the use of different types of hardeners. The known hardeners, however, have either given rise to new difficulties or have simply proved to be unsuitable.

These include the numerous known hardeners containing vinyl sulfone groups, of which divinyl sulfone (DE-PS No. 872,153) is among the longest known. The use of divinyl sulfone is contra-indicated by its toxicity.

Aromatic vinyl sulfone compounds have been disclosed in DE-PS No. 1,100,942 and heterocyclic vinyl sulfone compounds containing nitrogen or oxygen as hetero atoms in DE-OS No. 1,147,733. Bis-vinyl sulfonyl -alkyl compounds are described as hardeners in DE-PS No. 1,808,685 and DE-OS No. 2,348,194.

The known vinyl sulfone compounds have proved to be unsatisfactory as hardeners in numerous respects. They are either not sufficiently soluble in water and require special measures to make them usable in photographic gelatin layers or they have an adverse effect on the drying properties of the layers. The fact that these compounds increase the viscosity of the casting solution to an extent which seriously interferes with casting has been found to be particularly disadvantageous.

Tris- and tetrakis-vinyl sulfone have been described but are virtually unusable on account of their high insolubility in aqueous solutions and the increase in viscosity caused by them. Although water-soluble compounds may be obtained by the partial reaction of tris- and tetrakis-vinyl sulfones with amino alkyl sulfonic acids, this reaction substantially reduces the hardening effect.

Tris- and tetrakis-sulfonyl-ethyl sulfates have also been described as cross-linking agents but they have the disadvantage that hardening only sets in after some time in storage or after treatment with alkaline baths. The compounds have a high molecular weight and the salt content of the layers is unacceptably increased by them.

It is an object of the present invention to develop a hardening process for photographic layers containing gelatin by which the difficulties in the casting process caused by increases in the viscosity of the casting solutions due to premature cross-linking of gelatin can be prevented and which has no deleterious effect on the photographic properties, in particular of color photographic materials, and gives rise to no difficulties when the materials are subsequently processed in photographic baths. It is desirable to achieve very high solubility and rapid hardening after drying of the layers.

The present invention thus provides a process for the hardening of a photographic material consisting of a layer support and at least one gelatin-containing layer applied thereto, using a compound which is reactive with the amino groups of gelatin as a cross linking agent, characterised in that a compound containing at least one vinyl sulfone group and at least one sulfonyl ethyl sulfate group in the form of their salts is incorporated as a cross-linking agent in the casting composition of the gelatin-containing layer(s) or in the gelatin-containing layer(s) applied to the layer support.

The compounds used according to the invention as cross linking agents correspond to the following general formula:

$$(-Y-SO_2-CH_2-CH_2-OSO_3\ominus Me\oplus)_n$$

$$^{Z}(-Y-SO_2-CH=CH_2)_m$$

wherein

S = a divalent to n+m-valent aliphatic, saturated or olefinically unsaturated, straight chain or branched chain, optionally substituted hydrocarbon group having 1 to 9 carbon atoms and optionally containing oxy groups, or a divalent to n+m-valent, optionally substituted, preferably 5-membered or 6-membered, aromatic or partially or completely hydrogenated carbocylic or heterocyclic group, e.g. a group derived from cyclohexane, benzene, piperazine or hexahydrotriazine, or the group $$NaSO_3-O-\underset{\underset{H}{|}}{C}=,$$

Y = a single bond, a branched chained or straight chained alkylene group having 1 to 4 carbon atoms, in which the chain may be interrupted by oxy, carbonyl and imino groups, or which may contain further substituents such as phenyl, n = an integer of from 1 to 3, m = an integer of from 1 to 3, and Me⊕ = an alkali metal ion.

Compare with the known sulfoethyl sulfates, the compounds according to the invention have the advantage of hardening rapidly even without the addition of compounds to increase their pH (pH 9).

Compared with bis-, tris- and tetrakis-vinyl sulfones, they have the advantage of being water-soluble and highly diffusible. The compounds according to the invention do not increase the viscosity of the casting solution at the pH values of 6 to 7 generally employed for casting.

Compared with the raction products of tris- or tetrakis-vinyl sulfones with amino alkane sulfonic acids, the compounds according to the invention have the advantage of being more highly active. Whereas the water-solubilizing group in the vinyl sulfonesulfonyl ethyl sulfates according to the invention can be split off reversibly to form a group which is reactive with gelatin, a vinyl sulfone group in the known compound is irreversibly blocked by the reaction with amino alkane sulfonic acid.

The following are given as examples of the cross-linking compounds according to the invention:

1. $C(CH_2-SO_2-CH_2-CH_2-O-SO_3\ominus Na\oplus)_2$
$(CH_2-SO_2-CH=CH_2)_2$

2. $C(CH_2-O-CH_2-SO_2-CH_2-CH_2-OSO_3\ominus Na\oplus)_2$
$(CH_2-O-CH_2-SO_2-CH=CH_2)_2$ 3. $C_2H_5-C(CH_2-SO_2-CH_2-CH_2-OSO_3\ominus Na\oplus)_1$
$(CH_2-SO_2-CH=CH_2)_2$ 4. $CH_3-C(CH_2-SO_2-CH_2-CH_2-O-SO_3\ominus Na\oplus)_2$
$CH_2-SO_2-CH=CH_2$ 5. $C_8H_{17}-C(CH_2-SO_2-CH_2-CH_2-O-SO_3\ominus Na\oplus)_2$
$CH_2-SO_2-CH=CH_2$ 6. $CH_2-SO_2-CH_2-CH_2-O-SO_3\ominus Na\oplus$
$CH_2-SO_2-CH=CH_2$ 7. $CH_2-SO_2-CH_2-CH_2-O-SO_3\ominus K\oplus$
$O$
$CH_2-SO_2-CH=CH_2$ 8. 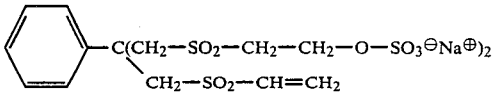

9. $CH_2-(CH_2-SO_2-CH_2-CH_2-O-SO_3\ominus Na\oplus)$
$CH-(CH_2-SO_2-CH_2-CH_2-O-SO_3\ominus Na\oplus)$
$CH_2-(CH_2-SO_2-CH=CH_2$ 10. 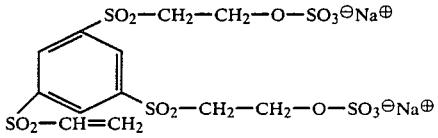

11. 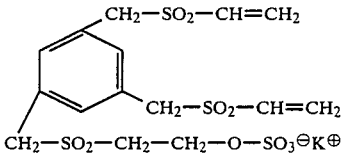

12. 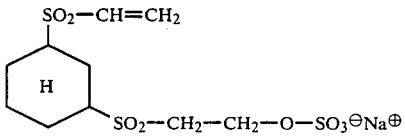

13. 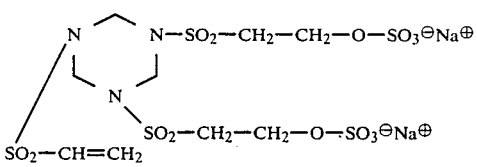

-continued

14.

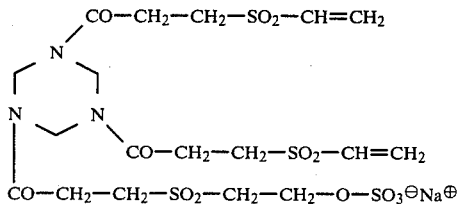

15.

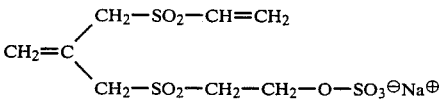

16.

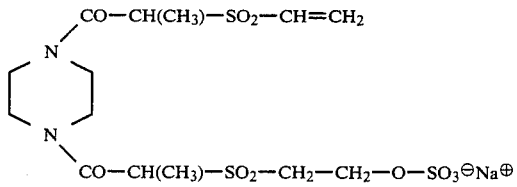

17.

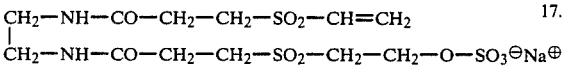

18.

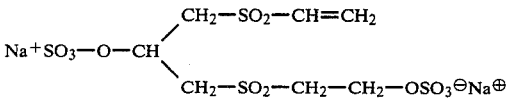

19.

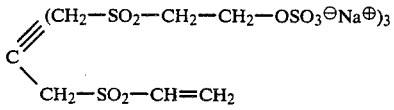

20.

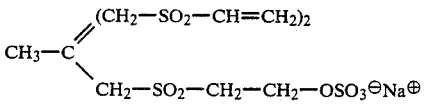

The process of preparation of the cross-linking compounds is illustrated below with reference to the preparation of compounds 1, 6 and 20. All other compounds may be prepared accordingly.

PREPARATION OF COMPOUND 1

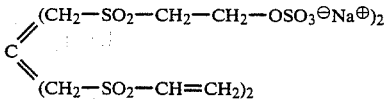

Stage 1

$C(CH_2—SO_2—CH_2—CH_2—OSO_3^{\oplus}Na^{\ominus})_4$ 10.1 g of tetrakis-hydroxyethyl-sulphonylmethylmethane $C(CH_2—SO_2—CH_2—CH_2—OH)_4$ are stirred into 50 ml of absolute dioxane. 18.6 g of chlorosulfonic acid are added drop-wise with cooling at 10° C. Stirring of the mixture is then continued at room temperature. A clear solution is obtained within a short time. A colorless reaction product precipitates after the solution has been left to stand at room temperature for 3 days. The product is suction-filtered and washed two or three times with a little cold dioxane. The substance is dried over phosphorus pentoxide. Yield: 17 g.

The compound is dissolved in ice water to form a concentrated solution and the pH is adjusted to 5 by the addition of aqueous sodium bicarbonate solution. The resulting aqueous solution is then evaporated to dryness under vacuum. The product is triturated with acetone and suction-filtered. Yield: 22 g. According to NMR measurement, the compound contains no vinyl sulfone groups.

Stage 2

An approximately 15% solution is prepared by dissolving the compound from Stage 1. The exact concentration of the tetrasulfate is determined by the hydrolysis reaction on a sample. This is carried out by adding an excess of N/10 sodium hydroxide solution to an exactly neutralized sample. The sample is then back-titrated with N/10 hydrochloric acid after hydrolysis of the tetrasulfate. To 741 g of a 12.3% solution (91.2 g of compound from stage 1) is added a spatula tip of dinitrobenzoic acid, followed by the drop-wise addition, with vigorous stirring of 600 ml of 1% sodium hydroxide solution at room temperature, the pH being constantly maintained at 9–10. The reaction mixture is then stirred for 2 hours at room temperature, adjusted to pH 5 with dilute sulfuric acid, and filtered. The compound is stable for 3 months at room temperature in this form. By analytical determination, the compound is found to contain two sulfate groups per molecule.

PREPARATION OF COMPOUND 6

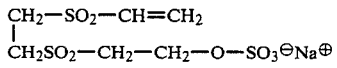

Stage 1

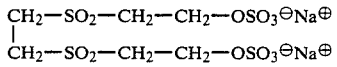

49.2 g of bis-hydroxyethyl-sulfonyl ethane

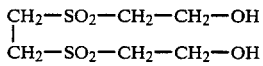

are suspended in 150 ml of dioxane and stirred. 93.2 of chlorosulfonic are added drop-wise to the mixture with vigorous stirring at 10° C. Stirring is then continued for 1 hour and the reaction mixture is left to stand overnight with exclusion of moisture. The reaction product which precipitates is suction-filtered and washed several times with absolute dioxane. The product is dried over phosphorus pentoxide in an exsiccator and then dissolved in 200 ml of ice water and the solution obtained is adjusted to pH 5 with 10% sodium bicarbonate solution. The solution is filtered and its content is determined by the hydrolysis reaction with N/10 sodium hydroxide solution and back titration with N/10 acid.

Stage 2

A small quantity of dinitrobenzoic acid is added at room temperature to 218 g of a 10.2% solution of the disulfate, and 35.5 g of a 5% sodium hydroxide solution are then added drop-wise, care being taken to ensure that the pH does not rise above 10. The mixture is then stirred for 10 minutes and the pH is adjusted to 5 with sulfuric acid. The sulfate group content is found to be 1 by hydrolysis of a sample with N/10 sodium hydroxide solution and back titration with acid. The compound is stable in aqueous solution for at least 3 months.

PREPARATION OF COMPOUND 20

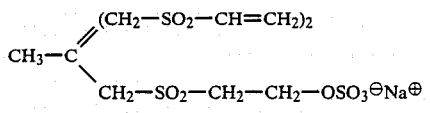

Stage 1

$CH_3—C(CH_2—SO_2—CH_2—CH_2—OSO_3^{\ominus}Na^{\oplus})_3$ is stirred into 200 ml of absolute dioxane, and 69.9 g of chlorosulfonic acid are added drop-wise at 10° C. The mixture is then stirred for 1 hour at room temperature and left to stand overnight. The clear reaction mixture is concentrated by evaporation under vacuum. The residue is dissolved in 200 ml of ice water. The solution is cooled with ice and at the same time rapidly adjusted to pH 5 with sodium bicarbonate solution and then filtered. The concentration is determined by hydrolysis with an excess of N/10 sodium hydroxide solution and back titration with sulfuric acid.

Stage 2

32 g of 5% sodium hydroxide solution are slowly added drop-wise with stirring to 140 g of a 10.4% solution of the compound from Stage 1 (tris-sulfate) at room temperature with the addition of a small quantity of dinitrobenzoic acid. The pH is maintained at 9 to 10. When the addition of sodium hydroxide has been completed, the mixture is stirred for half an hour at room temperature, during which time the pH adjusts to 7.3. The pH is then adjusted to 5 by the addition of dilute sulfuric acid. A water clear liquid is obtained. The sulfate group content is determined analytically by hydrolysis. The compound is found still to contain 1 sulfate group. The aqueous solution is stable for at least 3 months.

The hydroxyethyl sulfone compounds required for the reaction may be prepared in known manner, as described in Ullman Volume 14, page 620, in Houben-Weyl Volume IX, page 247 or in DT-PS No. 965,902, e.g. from the corresponding halogen alkanes by reaction with hydroxyalkyl mercaptans and oxidation of the resulting sulphides to hydroxyethyl sulfones with $H_2O_2$.

The cross-linking agents used according to the invention may be added to the casting solution by dosing devices either some time before casting or immediately before casting. The compounds may also be added to an over-casting solution which is poured over the finished photographic material as a hardening coat. Alternatively, the previously prepared combination of layers may be passed through a solution of the cross-linking agent, thereby receiving the required quantity of cross-linking agent. Lastly, in multilayered arrangements, e.g. color films and color photographic paper, the cross-linking agents according to the invention may be incorporated in the whole arrangement by intermediate layers.

For the process according to the invention, the cross-linking agents are generally employed in a quantity of from 0.1 to 15% by weight, preferably from 1 to 10% by weight, based on the dry weight of gelatin in the coating solution. The exact time at which the cross-linking agent is added to the coating solution is not critical but silver halide emulsions are preferably treated with hardener after chemical ripening.

The term "photographic layers" is to be understood in this context to cover layers in general which are used for photographic materials, such as, for example, light-sensitive silver halide emulsion layers, protective layers, filter layers, anti-halation layers, backing layers or photographic auxiliary layers in general.

Examples of light-sensitive emulsion layers for which the hardening process according to the invention is eminently suitable include, for example, layers based on emulsions which have not been sensitized, X-ray emulsions and other spectrally sensitized emulsions. The hardening process according to the invention has also been found suitable for hardening the gelatin layers used for the various photographic black-and-white processes and color photographic processes, such as negative, positive and diffusion-transfer processes or printing processes. The process according to the invention has found to be particularly advantageous for hardening photographic layer combinations intended for carrying out color photographic process, e.g. those containing emulsion layers with color couplers or emulsion layers intended to be treated with solutions containing color couplers.

The action of the compounds used according to the invention is not impaired by the usual photographic additives. The hardeners are also unaffected by photographically active substances such as water-soluble and emulsified water-insoluble color components, stabilizers, sensitizers and the like. They also have no deleterious effect on the light-sensitive silver halide emulsion.

The light sensitive components of the emulsion layers may include any known silver halides, such as silver chloride, silver iodide, silver bromide, silver iodobromide, silver chlorobromide, silver chloroiodobromide and the like. The emulsions may be chemically sensitized with noble metal compounds, e.g. compounds of ruthenium, rhodium, palladium, iridium, platinum, gold and the like, such as ammonium chloropalladate, potassium chloroplatinate, potassium chloropalladate or potassium chloroaurate. They may also contain special sensitizing agents, such as sulphur compounds, tin(II) salts, polyamines or polyalkylene oxide compounds. The emulsions may also be optically sensitized with cyanine dyes, merocyanine dyes and mixed cyanine dyes.

Lastly, the emulsions may contain various couplers, e.g. colorless couplers or colored couplers, stabilizers such as mercury compounds, triazole compounds, azaindene compounds, benzothiazole compounds or zinc compounds, wetting agents such as dihydroxy alkanes, substances to improve the film-forming properties, e.g. the particulate high polymers dispersed in water obtained from the emulsion polymerisation of alkyl acrylate or alkyl methacrylate with acrylic or methacrylic acid; also styrene/maleic acid copolymers or copolymers of styrene and maleic acid anhydride semi-alkyl esters, coating auxiliaries such as polyethylene glycol lauryl ether and various other photographic additives.

It is remarkable that when the cross-linking agents according to the invention are used in color photographic materials containing couplers, e.g. magenta couplers of the 5-pyrazolone series, cyan couplers of the naphthol or phenol series and yellow couplers of the closed ketomethylene series and so-called divalent and tetravalent couplers derived from the above mentioned couplers and so-called masking couplers having an aryl azo group in the active position, they do not give rise to any color change in the photographic materials.

The cross-linking agents according to the invention are particularly distinguished from the known hardeners of the vinyl sulfone series in that they in no case increase the viscosity of the casting solution by premature cross-linking in the solution. This adverse effect is found in the known vinyl sulfone hardeners, especially those compounds which contain more than two reactive vinyl sulfonyl groups. The casting solutions of these known hardeners will only keep for a short time and considerable technical effort is required to overcome the resulting difficulties.

EXAMPLE 1

The increases in viscosity of 10% aqueous solutions in dependence upon the time and pH under the action of two hardeners not according to the invention were compared with the results obtained when using a compound according to the invention. 1% by weight of hardener, based on the quantity of gelatin, was added in each case to a 10% aqueous gelatin solution.

Compound 19 according to the invention

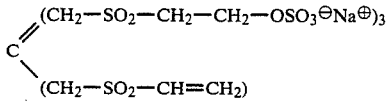

The following compounds were used for comparison:

$C(CH_2—SO_2—CH=CH_2)_4$ VVI $(CH_2=CH—SO_2—CH_2)_3=C—CH_2—SO_2CH_2—CH_2—NH—CH_2—CH_2—SO_3^{\ominus}NA^{\oplus}$ VV2

The viscosities were measured hourly at 40° C. The mixtures were left to digest for some time (about 5 hours) at 40° C. The behaviour of the samples was investigated at pH 6 and 6.5. The pH values were adjusted by means of a buffer mixture of primary potassium phosphate and secondary sodium phosphate (6, 6.5).

The results are shown in FIG. 1. Curves 1 and 2 entered in dash-dot lines apply to compound 19 according to the invention at pH 6 (curve 1) and pH 6.5 (curve 2). The broken line curves 5 (pH 6) and 6 (pH 6.5) apply to comparison compound VV1 and curves 3 (pH 6) and 4 (pH 6.5) to comparison compound VV2. Comparison compound VV1 cross-links gelatin after 4 hours at pH 6.5, as shown in curve 6. Comparison compound VV2 also effects cross-linking in about 4 hours at pH 6 (curve 3) and after only 2 hours at pH 6.5 (curve 4).

The results clearly show that a steep rise in viscosity takes place within a few hours when the compounds not according to the invention are used, whereas no increase in viscosity is found at either of the two pH values when the compound according to the invention is used. 10% gelatin casting solutions therefore cannot be digested with comparison compounds VV1 and VV2, and when the solutions are cast, they form irregularities on the support owing to the increase in viscosity.

EXAMPLE 2

The compounds according to the invention were added in the form of aqueous solutions at pH 6.2, in each case in quantities corresponding to 0.08 mol, based on 1000 g of gelatin, to 100 ml of a photographic silver bromide gelatin emulsion ready for casting, which contained 10% by weight of gelatin.

The mixture was in each case vigorously stirred, cast on a previously prepared cellulose triacetate support by means of a conventional casting machine, and dried.

The material was in each case stored for one day at 23° C. and three days under tropical conditions of 36° C./90% relative humidity, and cross-linking was then tested by determining the melting point of the layer, the west scratch strength and the swelling factor. A high melting point of the layer, high wet scratch strength and low swelling factor are an indication of good cross-linking.

The results are summarised in the table given below. The various determinations were carried out by the methods described below.

Cross-linking of the photographic material is determined from the melting point of the layers, which may be found as follows.

A layer combination cast on a support is half dipped in water which is continuously heated up to 100° C. The temperature at which the layer flows from the support (formation of streaks) is taken as the melting point or melting-off point. By this method of measurement, protein layers which have not been hardened in no case show an increase in melting point. The melting-off point under these conditions is from 30° to 35° C.

To determine the water absorption, the sample is developed as a black sheet in a conventional color development process and weighed after excess water has been stripped off after the final bath. The sample is then dried and again weighed. The difference between the two weighings, converted from the surface area of the sample to 1 $m^2$, is expressed as the water absorption per $m^2$.

Swelling is determined gravimetrically after 10 minutes treatment of a sample strip in distilled water at 22° C. The swelling factor is defined as:

$$\frac{\text{Weight of wet layer}}{\text{Weight of dry layer}} = \text{swelling factor}$$

To determine the wet scratch strength, a metal tip of specified size is passed over the wet layer and loaded with an increasing weight. The wet scratch strength is defined as the weight at which the tip leaves a visible scratch trace on the layer. A heavy weight corresponds to a high wet scratch strength.

TABLE 1

| Hardener 0.08 Mol/kg of Gelatin | Storage 1 day 23° C. Layer Melting Point | Swelling Factor | Wet Scratch strength (g) | Storage 3 days 36° C., 90% relative humidity Layer Melting Point | Swelling Factor | Wet Scratch Strength (g) |
|---|---|---|---|---|---|---|
| Compound 1 | 100° C. | 4.2 | 500 | 100° C. | 1.9 | 750 |
| Compound VV3 | 40° C. | — | — | 100° C. | 2.2 | 700 |
| Compound 3 | 100° C. | 4.5 | 450 | 100° C. | 2.5 | 750 |
| Compound VV4 | 38° C. | — | — | 100° C. | 2.7 | 600 |
| VV3 | $C(CH_2—SO_2—CH_2—CH_2—O—SO_3^{\ominus}Na^{\oplus})_4$ | | | | | |
| VV4 | $CH_3C(CH_2—SO_2—CH_2—CH_2—O—SO_3^{\ominus}Na^{\oplus})_3$ | | | | | |

It may be seen from table 1 that compounds 1 and 3 according to the invention give rise to layers which are fast to boiling (layer melting points above 100° C.) after only 1 day's storage and have high wet scratch values, in contrast to the completely sulfated comparison compounds VV3 and VV4 which only show a hardening effect in the layers after 3 days' storage under tropical conditions. The compounds according to the invention are much more rapid in their action and thus significantly differ from the comparison compounds. The casting solutions may be left to stand for 1 hour without undergoing any increase in viscosity, thus showing the desired result that the compounds according to the invention undergo little reaction with gelatin in solution.

The layers showed no serious differences from the unhardened layer after development and fixing. Sensitivity, fog values and γ-values were unchanged. The hardeners were found to be inert towards the silver halide emulsion even after prolonged storage of the layers.

EXAMPLE 3

A color photographic material to be viewed by reflected light was prepared by applying the layers indicated below in succession to a polyethylene-laminated paper support which had been covered with an adhesive coating. The emulsion layers of the material contained the usual addition of wetting agents, stabilizers, etc., but no hardener.

1. The bottom layer consisted of a blue-sensitive silver bromide emulsion layer 4μ in thickness containing, per kg of emulsion, 25.4 g of silver (88% AgBr, 12% AgCl), 80 g of gelatin and 34 g of the yellow component corresponding to the formula:

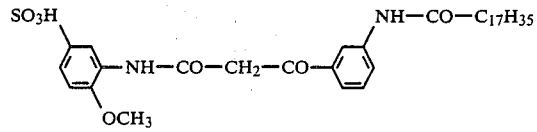

2. The intermediate layer was a gelatin layer 1μ in thickness,
3. The middle layer consisted of a green-sensitive silver chlorobromide emulsion layer 4μ in thickness containing, per kg of emulsion, 22 g of silver (77% AgCl, 23% AgBr), 80 g of gelatin and 13 g of the magenta component corresponding to the formula:

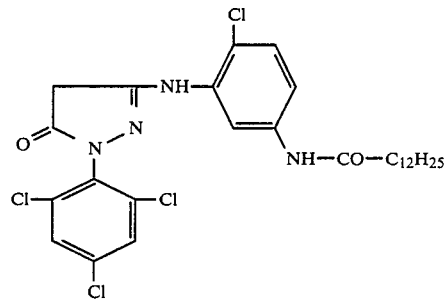

4. an intermediate layer 1μ in thickness as indicated under 2,
5. the top layer consisted of a red-sensitive silver chlorobromide emulsion layer 4μ in thickness containing, per kg of emulsion, 23 g of silver (80% AgCl, 20% AgBr), 80 g of gelatin and 15.6 g of the cyan component corresponding to the formula

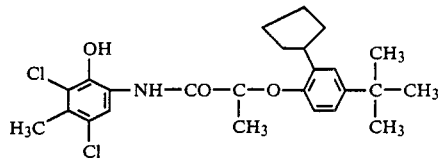

and 6. covered by a protective layer of gelatin 1μ in thickness.

Aqueous solutions containing 1/200 mol of compound 1, 20 and 6, respectively, per 100 ml were applied in each case to the dried layer packet and the packet was then dried. The layers were investigated for cross-linking after 5 days storage at 22° C. with exclusion of moisture and after storage under controlled climatic conditions and under tropical conditions.

The results are shown in the following table.

| Hardener Application 1/200 Mol per 100 ml of casting solution | After storage 5 days 23° C. LMP* | SF | WSS (g) | After storage 37 hours 57°/34% Relative Humidity LMP* | SF | WSS (g) | After storage 3 days 36° C./90% Relative humidity LMP* | SF | WSS (g) |
|---|---|---|---|---|---|---|---|---|---|
| Compound 1 | 100° C. | 2.3 | 300 | 100° C. | 1.6 | 450 | 100° | 1.5 | 400 |
| Compound 20 | 100° C. | 2.1 | 350 | 100° C. | 1.7 | 450 | 100° | 1.6 | 400 |
| Compound 6 | 100° C. | 3.0 | 150 | 100° C. | 2.1 | 2.50 | 100° | 1.9 | 300 |
| Blank Application | 40° C. | — | — | 40° C. | — | — | 40° C. | — | — |

-continued

| Hardener Application 1/200 Mol per 100 ml of casting solution | After storage 5 days 23° C. | | | After storage 37 hours 57°/34% Relative Humidity | | | After storage 3 days 36° C./90% Relative humidity | | |
|---|---|---|---|---|---|---|---|---|---|
| | LMP* | SF | WSS (g) | LMP* | SF | WSS (g) | LMP* | SF | WSS (g) |
| Water | | | | | | | | | |

SF = Swelling factor in water at 22° C.
WSS = Wet scratch strength in a commerical color developer at 38°.
*LMP = Layer melting point in water.

The table shows that the entire layer combination is hardened by the hardening system diffusing into it. The individual layers are homogeneously hardened. The hardening intensity does not diminish with the distance from the surface. The result demonstrates the excellent diffusibility of the compounds according to the invention.

The layers obtained after photographic processing in conventional processing baths were comparable in their photographic values such as sensitivity, fog and gradation. Used in this form, the hardening system according to the invention is inert towards the emulsion and the color couplers.

EXAMPLE 4

The hardening effect is also excellent in black-and-white photographic materials containing gelatin. Compounds 2, 3 and 6 were used in each case in quantities of 5 g to 100 g of gelatin. The casting solutions contained 35 g of silver halide. The hardening properties were tested after storage of the material under four different atmospheric conditions.

Atmospheric conditions 1: 23° C., atmospheric moisture, 2 days
Atmospheric conditions 2: 23° C., exclusion of moisture, 7 days
Atmospheric conditions 3: 57° C., 34% relative humidity, 36 hours
Atmospheric conditions 4: 36° C., 90% relative humidity, 7 days.

The results are summarised in the following table.

| Compound | Atmospheric Conditions 1 | | | Atmospheric Conditions 2 | | | Atmospheric Conditions 3 | | Atmospheric Conditions 4 | |
|---|---|---|---|---|---|---|---|---|---|---|
| | Layer melting point after 2 days | SF | WSS (g) | Layer melting point after 7 days | SF | WSS (g) | SF | WSS (g) | SF | WSS (g) |
| Compound 2 | 100° C. | 3.8 | 500 | 100° C. | 3.4 | 500 | 2.8 | 700 | 1.9 | 800 |
| Compound 3 | 100° C. | 4.5 | 450 | 100° C. | 4.1 | 450 | 3.2 | 500 | 2.7 | 750 |
| Compound 6 | 50° C. | — | — | 100° C. | 4.4 | 200 | 3.8 | 500 | 2.6 | 550 |

SF = Swelling factor in water at 20° C.
WSS = Wet scratch strength in a developer bath at 50° C.

The table shows that the melting point rises to above 100° C. within a few days. The hardened photographic materials are therefore suitable for processing at 38° to 50° C. after only a short time in storage. The photographic properties such as fogging, sensitivity and gradation are not changed.

EXAMPLE 5

Samples of a photographic paper emulsion containing 80 g of gelatin and 35 g of silver halide per liter and in each case 3% by weight of a cross-linking agent according to the invention were cast on polyethylene laminated paper supports which had been covered with an adhesive coating. The usual casting auxiliaries such as wetting agents, stabilizers and optical sensitizers had previously been added to the samples of emulsion. The layer melting points were determined immediately after drying.

When the photographic material had been stored for 24 hours, the layer melting points were determined after the material had been passed through a photographic developer bath for black-and-white material adjusted to 22° C.

The developer solution had the following composition:

6 g of metol
3 g of hydroquinone
30 g of sodium sulfite
25 g of anhydrous soda
2 g of potassium bromide
Water up to 1 liter.

The example shows that the hardeners according to the invention effect cross-linking fairly rapidly and the cross-linking is not reduced in the alkaline developer solution but enhanced.

| Hardener | Melting point after drying | Melting point after developer bath | |
|---|---|---|---|
| | | 1½ | 3 min |
| Comp. 1 | 100° | 100° | 100° |
| Comp. 3 | 100° | 100° | 100° |
| Comp. 4 | 100° | 100° | 100° |
| Comp. 15 | 50° | 100° | 100° |
| Comp. 18 | 60° | 100° | 100° |

I claim:

1. A process of hardening a photographic material consisting of a layer support and at least one gelatin-containing layer applied to this support, comprising incorporating in the casting composition of a gelatin-containing layer applied to the layer support or in a gelatin-containing layer applied to the layer support a cross-linking agent which is reactive with the amino groups of the gelatin wherein the cross-linking agent is a compound containing at least one sulfone group and at least one vinyl sulfonyl ethylsulfate group as a water-solubilizing group in the form of their salts and wherein the cross-linking activity of the compound with the gelatin is carried out after drying said gelatin-containing layer and at a Ph value of from 6 to 7.

2. A process according to claim 1, characterised in that the cross-linking agent used is a compound corresponding to the following general formula:

$$(-Y-SO_2-CH_2-CH_2-OSO_3^{\ominus}Me^{\oplus})_n$$

$$Z(-Y-SO_2-CH=CH_2)_m$$

wherein

Z=a divalent to n+m valent aliphatic, saturated or olefinically unsaturated straight chain or branched chain, optionally substituted hydrocarbon group having 1–9 carbon atoms which may contain oxy groups, or a divalent to n+m valent, optionally substituted, aromatic or partially or completely hydrogenated carbocyclic or heterocyclic group, or the group $$NaSO_3-O-\underset{\underset{H}{|}}{C}=,$$

Y=a single bond, a branched chain or straight chain alkylene group having 1 to 4 carbon atoms in which the chain may be substituted and interrupted by oxy, carbonyl and imino groups, n=an integer of from 1 to 3, m=an integer of from 1 to 3, and $Me^{\oplus}$=an alkali metal ion.

3. A process according to claims 1 or 2, characterised in that the casting composition of a gelatin-containing layer to be applied contains the cross-linking agent.

4. A process as claimed in claims 1 or 2 characterized in that the photographic material is a multilayer material and wherein said cross-linking agent is incorporated into at least one of the casting solutions of the gelatin containing layers of the multilayer material and in such a quantity that the concentration of said agent in said multilayer material is of from 0.5 to 5 percent based on gelatin.

* * * * *